US006461018B1

(12) United States Patent
Chanslor

(10) Patent No.: US 6,461,018 B1
(45) Date of Patent: Oct. 8, 2002

(54) DECORATIVE GROUND LIGHTING STAKE ASSEMBLY AND SYSTEM

(75) Inventor: Lewis P. Chanslor, St. George, UT (US)

(73) Assignee: Sunhill Properties, P.C., St. George, UT (US)

( * ) Notice: Subject to any disclaimer, the term of this patent is extended or adjusted under 35 U.S.C. 154(b) by 0 days.

(21) Appl. No.: 09/505,817

(22) Filed: Feb. 17, 2000

Related U.S. Application Data

(63) Continuation-in-part of application No. 09/165,752, filed on Oct. 2, 1998.
(60) Provisional application No. 60/061,108, filed on Oct. 3, 1997.

(51) Int. Cl.[7] ..... F21V 21/00
(52) U.S. Cl. ..... 362/249; 362/191; 362/431; 248/71; 248/530; 248/532
(58) Field of Search ..... 362/153, 190, 362/191, 249, 391, 392, 393, 431, 806; 248/511, 530, 532, 176, 71, 51, 74.1, 74.2, 74.3

(56) References Cited

U.S. PATENT DOCUMENTS

| | | | | | |
|---|---|---|---|---|---|
| 3,758,062 A | | 9/1973 | Caldwell et al. | 248/156 |
| 4,774,648 A | * | 9/1988 | Kakuk et al. | 362/302 |
| 4,858,877 A | | 8/1989 | Carter | 248/545 |
| 4,996,636 A | * | 2/1991 | Lovett | 362/431 |
| 5,036,447 A | * | 7/1991 | Taylor | 362/431 |
| 5,062,028 A | * | 10/1991 | Frost et al. | 362/183 |
| 5,481,444 A | | 1/1996 | Shultz | 362/249 |
| 5,504,397 A | * | 4/1996 | Chien | 315/185 |
| 5,526,243 A | | 6/1996 | Masters | 362/122 |
| 5,570,952 A | * | 11/1996 | Portz, Jr. | 362/431 |
| 5,597,229 A | * | 1/1997 | Plichta et al. | 362/153.1 |
| 5,639,057 A | | 6/1997 | Yeomans | 248/530 |
| 5,667,174 A | | 9/1997 | Adams | 248/156 |

* cited by examiner

*Primary Examiner*—Sandra O'Shea
*Assistant Examiner*—Ismael Negron
(74) *Attorney, Agent, or Firm*—Workman, Nydegger & Seeley

(57) ABSTRACT

A decorative lighting stake assembly maintains at least one decorative light above a surface. The decorative lighting stake assembly includes: (i) a holder configured to selectively hold at least one decorative light therein; and (ii) a stake selectively, removably coupled to the holder. The stake selectively couples the holder to the ground surface. The stake is separately deployable from the holder prior to coupling the holder to the stake. In use, the stake is selectively driven partially into the ground surface, after which the holder is selectively coupled to the stake. The stake has a first end and a second end. The first end is configured to be inserted into a ground surface to a desired depth and the second end is configured to be coupled to the holder. The holder has a receiving end which selectively, removably receives at least one individual light socket therein, so that at least one light is selectively deployed by inserting a socket of the light into the receiving end. An improved stake having slots in the sharpened insertion end is also disclosed.

25 Claims, 9 Drawing Sheets

DECORATIVE GROUND LIGHTING STAKE ASSEMBLY AND SYSTEM

This nonprovisional patent application is a continuation-in-part of a nonprovisional patent application filed Oct. 2, 1998, Ser. No. 09/165,752, entitled "DECORATIVE GROUND LIGHTING SYSTEM," to Lewis P. Chanslor, which is incorporated herein in its entirety by reference and which claims priority to a provisional patent application filed in the United States Patent and Trademark Office on Oct. 3, 1997 and having an application of Ser. No. 60/061,108 entitled "CANDLESTICK LIGHT-HOLDERS" to Lewis P. Chanslor, which is also incorporated herein in its entirety by reference.

BACKGROUND OF THE INVENTION

1. Priority Data

2. Field of the Invention

This invention is in the field of lighting systems. More specifically, this invention is in the field of decorative ground lighting systems.

3. The Relevant Technology

Outdoor lighting is a popular way to decorate homes and provide illumination for dark walkways. Typical outdoor lighting includes holiday lights, commonly known as Christmas lights or other such holiday lights. While such lights often bring great pleasure and excitement to those viewing the lights, the lighting systems tend to be cumbersome and time consuming both to install and to maintain.

For example, certain lighting systems include clips which must be fastened to a roof, tree, pole, railing or other structure in order to mount the lighting systems outdoors. In addition, after finding the location to mount each individual clip, and mounting each clip, it is possible for one or more lights to fail. Often, if even a single light fails or "burns out" an entire strand of lights must be replaced. Replacing the entire strand of lights can mean removing the strand from its clipped location, then reclipping each of the new lights at the same location.

Even with lights which do not burn out, such clipped lights tend to fall from their locations, potentially subjecting the lights to damage and at the very least exhibiting an unsightly appearance. Lights which are placed onto or fall onto the ground without any additional support can be stepped on and crushed.

Other outdoor lighting systems feature a series of ground mounted holders or stakes having light bulbs and electrical cords extending therethrough or otherwise coupled thereto. The holders and bulbs, with their accompanying electrical cords are typically installed as a single, combined unit. Installation of such combined units often involves pressing the holders into the ground or digging a hole, installing the holders, then covering a portion of the holders with dirt or other material.

Since the holders, bulbs, and cords are installed as a unit, it is possible for the bulbs of such units to be broken during such installation or for the electrical cords to be sliced or otherwise damaged. For example, a delicate bulb can be broken while the unit is pressed into the ground. Such damage to the bulbs or cords can result in the loss of electricity to a single unit or to an entire lighting system comprising a series of units. Furthermore, the exposing or uncovering of live electrical wires during installation can present a potentially precarious scenario.

Replacement or repair of such combined units also typically requires removal of both the holder and the accompanying bulb and electrical cord. In the event units are permanently coupled in a series, the entire lighting system of a garden or yard, for example, must be removed. This can require both a great deal of time and labor to dig up previously implanted units. In addition, the removal of such combined units can damage delicate electrical systems.

Furthermore, certain receiving ends of typical light holders or stakes are configured for receiving only specially designed light fixtures, rather than a variety of different light fixtures currently on the market. Other light holders feature complicated upper receiving portions which are both expensive to manufacture and form a top heavy structure when placed into the ground.

Moreover, certain light-holding stake systems require the twisting or bending of the light fixture in order to couple the fixture to the receiving end of the stake. In addition to the placement of the light fixtures onto the receiving end of the stake, removing the light fixtures from the receiving end also requires such twisting or bending.

Pieces of small plastic pipe have been cut into one foot sections and inserted into the ground at approximately one foot intervals with Christmas lights clipped to the side at the top. However, the pieces failed to adequately hold the lights in a stable manner and exhibited an unsightly appearance.

Ground-mounted light-holding stakes can also be difficult to insert into the ground, such as in rough or rocky terrain. In addition, it is possible, upon insertion of the stakes, to damage the stakes, such as by damaging the tops of the stakes with a hammer or other tool.

OBJECTS AND BRIEF SUMMARY OF THE INVENTION

It is therefore an object of the invention to provide an improved decorative lighting system.

It is another object of the invention to provide a decorative lighting system including stakes which are separately deployable prior to stringing a string of decorative lights onto the stakes.

It is another object of the invention to provide a decorative lighting system wherein a string of lights can by deployed by simply inserting each socket on the string of lights into a corresponding receiving end of a stake.

It is another object of the invention to provide a decorative lighting system including stakes which can hold a variety of different light fixtures.

It is another object of the invention to provide a stake for holding a light fixture which can conveniently hold light fixtures in rows with electrical cords of the light fixtures extending on opposing sides of the stake.

Another object of the invention is to provide a stake for holding a light fixture which has the actual appearance of a candlestick.

Another object of the invention is to provide a light stake which is conveniently inserted into the ground.

Yet another object of the invention is to prevent damage to a light stake upon insertion into the ground.

Another object of the invention is to provide a light stake which conveniently orients wires extending therefrom.

Another object of the invention is to provide a light stake assembly which is conveniently mounted into a ground surface.

The present invention relates to a decorative lighting system for deploying a string of decorative lights above a ground surface. The system includes (i) a string of decorative lights; and (ii) a plurality of separately deployable stakes. The string of lights comprises a plurality of electrical sockets. Each socket receives a light bulb and is connected by wiring strung between each of the sockets.

Each stake holds an individual socket and is separately deployable prior to stringing the string of decorative lights onto the stakes. Each stake comprises (i) a sharpened end to facilitate driving the stake through the ground surface and into the ground to a desired depth; and (ii) a receiving end having a receptacle formed therein.

The receptacle is sized to removably receive one of the sockets of the light string. The receiving end includes at least one and preferably first and second slots therein into which the wiring of the light string is removably seated and secured. Thus, the string of lights can by deployed onto the stakes by simply inserting each socket on the string of lights into a corresponding receiving end of a stake, and inserting the wiring of the string of lights into the at least one slot of that stake.

Consequently, the stakes can be installed separately from the string of lights, preserving electrical wires and bulbs until after the stakes have been pounded into or otherwise mounted within the ground. Stakes can be strategically placed in desired locations before attempting to place bulbs and wires in the stakes. This prevents damage to such electrical wires and bulbs during installation and during site location. The stakes can also be stored or washed separately from the electrical cords and bulbs of the light string. Furthermore, if a single light or even the entire lighting system fails or burns out, the stakes can be left in their strategic position while the light string is removed and conveniently replaced.

The first and second slots in the receiving end run from a top end of the receptacle to a point near a bottom end of the receptacle. The wiring is conveniently accommodated by the slots. The socket and wiring are merely placed into the receptacle and slots of the previously deployed stake without having to twist or bend the socket or wiring. This makes the system easily deployable in separate, distinct portions.

In one embodiment, the slots run from a top end of the receptacle to a point near the ground surface when the stake is driven into the ground. Next, a clip means is provided for removable attachment onto and around the stake to secure the wiring to the stake at the point near the ground surface. This places the wiring adjacent the ground, exhibiting a tidy appearance and preventing people and pets from tripping on the wiring. In another embodiment, the slot is located at the sharpened end of the stake.

Another embodiment of the invention comprises cord means for joining each stake to at least one adjacent stake at a predetermined distance from one another. Thus, the stakes are coupled together in an organized fashion.

The preferred embodiment of the stake comprises a length of hollow pipe. Thus, the stake is lightweight and inexpensive to manufacture. The stake has no moving parts, is made from readily available and inexpensive materials and can be readily molded as a unitary body on a mass production basis. Optionally, however, the stake can be made from fairly commonly available pipes found in hardware stores and other retail and wholesale establishments. Such pipes can be cut into the desired lengths, after which one end of the pipe is slotted with opposing parallel slots and another end is cut with a slant cut.

The stake of the present invention is also convenient to place into or remove from the ground. Once the stakes are placed in the ground, the user then presses a light fixture into the receiving end. No twisting or bending of the fixture is required.

Yet another advantage of the stakes of the present invention is that the stakes can accommodate light fixtures having a clip thereon as well as light fixtures lacking clips. In one embodiment, for example, a clip coupled to the socket of a light fixture extends over the top of the rim of the receiving end of the stake of the present invention. In another embodiment, the receiving end is sized such that the clip is positioned within the open receiving end.

Examples of light fixtures held above a ground surface include Christmas lights or other light fixtures comprising a socket and an electrical cord coupled to the socket. The light bulb of the fixture may be removably or integrally coupled to the socket.

Upon placing a light into the receiving end of the invented stake, the system yields the appearance of an electrically lighted candlestick. One embodiment of the invention is thus a decorative lighting holder device which accommodates strings of white outdoor Christmas lights to simulate electrically lighted candlesticks.

Furthermore, the system of the present invention can be employed to maintain a variety of different light fixtures ranging in size from miniature to intermediate to large lights above the ground. In addition, since the stakes and light strings are separately deployable, they can be separately stored and separately shipped. Thus, the electrical wires of the light string do not become entangled with the stakes.

Yet another embodiment of the invention comprises a decorative lighting stake assembly which maintains at least one decorative light above a ground surface. The decorative lighting stake assembly may comprise, for example: (i) a holder configured to selectively hold at least one decorative light therein; and (ii) a stake selectively, removably coupled to the holder. The stake selectively couples the holder to the ground surface. The stake is separately deployable from the holder prior to coupling the holder to the stake.

Thus, in use, the stake is selectively driven partially into the ground surface, after which the holder is selectively coupled to the stake. The stake has a first end and a second end. The first end is configured to be inserted into the ground surface to a desired depth and the second end is configured to be coupled to the holder. The holder has a receiving end which selectively, removably receives a portion of at least one individual light therein, so that at least one light is selectively deployed by inserting a portion of the light into the receiving end.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
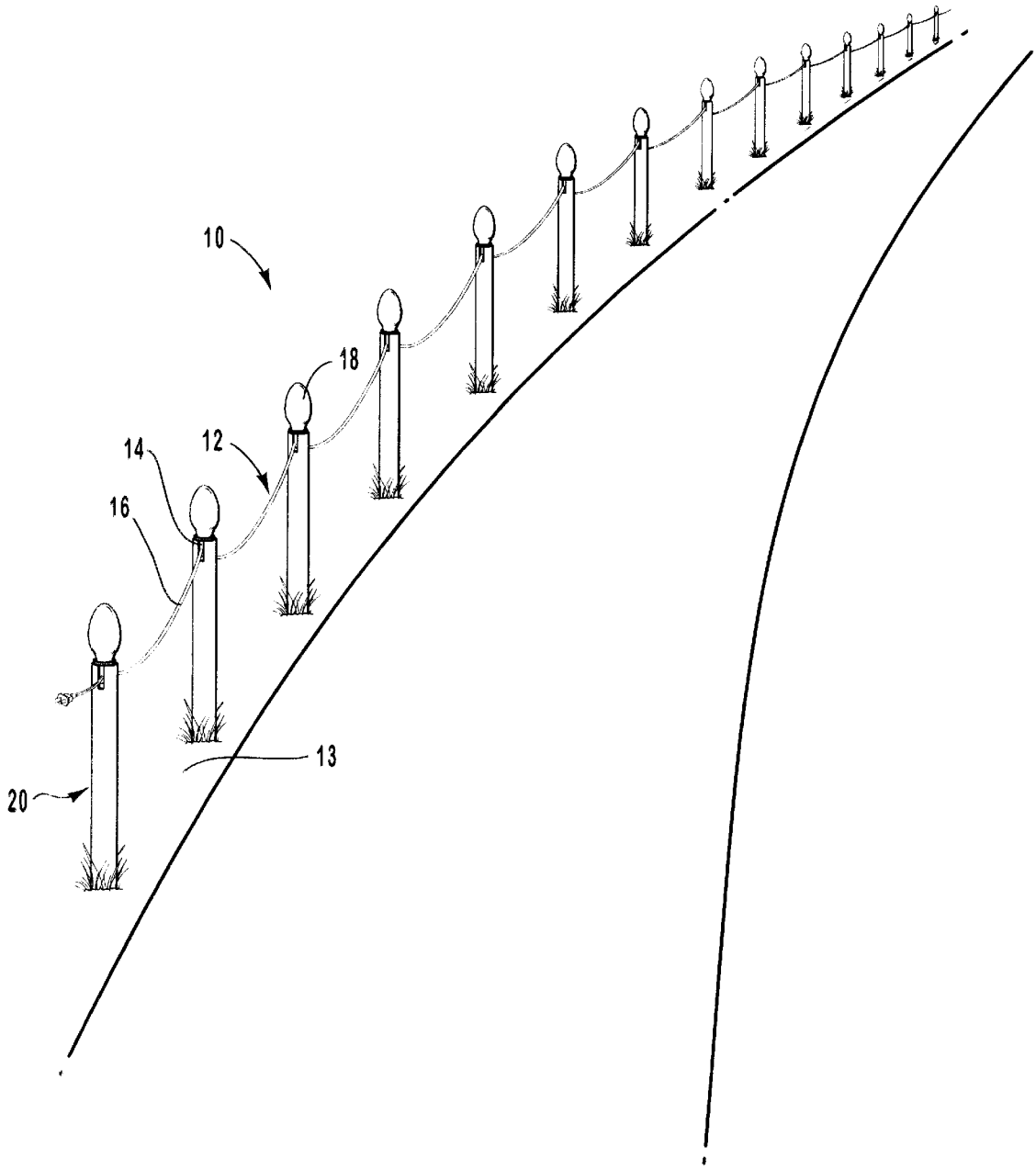
FIG. 1 is a perspective view of a decorative ground lighting system of the present invention disposed adjacent a lane or sidewalk, simulating the effect of a variety of different candles disposed along the lane or sidewalk.

An embodiment of a decorative lighting system 10 for deploying a string 12 of decorative lights above a ground surface 13 is shown in FIG. 1. System 10 comprises a string 12 of lights comprising a plurality of electrical sockets 14. Each socket 14 is connected by wiring 16 strung between each of the sockets 14. Each socket 14 receives a light bulb 18.

System 10 further comprises a plurality of separate stake means for holding the plurality of sockets 14. Each stake means holds an individual one of said sockets 14 and is separately deployable prior to stringing string 12 of decorative lights onto the stake means. Since each stake means is separately deployable, it is possible to initially deploy the stake means, then place the light string 12 thereon. This can make installation significantly more convenient because the user is not limited by wiring 16 and bulbs 18 during installation of the stake means. Optionally, the string 12 of lights can be removed while the stake means remains in the ground, in the case of inclement weather or replacement, for example.

Receiving end 22 also includes means for removably seating and securing wiring 16 so that string 12 of lights can be deployed by simply (i) inserting a socket 14 of light string 12 into receiving end 22, and (ii) inserting wiring 16 of light string 12 into the means for scaling and securing the wiring at receiving end 22.

Receiving end 22 also includes means for removably seating and securing wiring 16 so that string 12 of lights can be deployed by simply (i) inserting a socket 14 of light string 12 into receiving end 22; and (ii) inserting wiring 16 of light string 12 into the means for seating and securing the wiring at receiving end 22.

One example of a structure for performing the stated function of a means for removably seating and securing wiring 16 comprises at least one and preferably first and second opposing slots 26, 28 running from a top end 30 of said receptacle 24 to a point near a bottom end 32 of receptacle 24.

Wiring 16 of light string 12 is removably seated and secured so that light string 12 can be deployed by simply inserting each socket 14 of light string 12 into a corresponding receiving end 22 of stake 20 and inserting wiring 16 of light string 12 into at least one slot 26, 28. Slots 26, 28 are parallel to each other, as shown in the side view of FIG. 2. In the event a single slot is employed, both ends of the wiring can extend from the single slot.

In light of the configuration of system 10, stakes 20 can be installed separately from string 12 of lights, preserving electrical wires and bulbs until after stakes 20 have been mounted within the ground. Stakes 20 can be strategically placed in desired locations before attempting to place sockets 14 and wiring 16 in stakes 20. This prevents damage to electrical wires bulbs during installation and during site location. Stakes 20 can also be stored or washed separately from wiring 16 and bulbs 18. Furthermore, if a single light or even the entire lighting system fails or burns out, stakes 20 can be left in their strategic position while light string 12 is removed and conveniently replaced.

Figure 2:
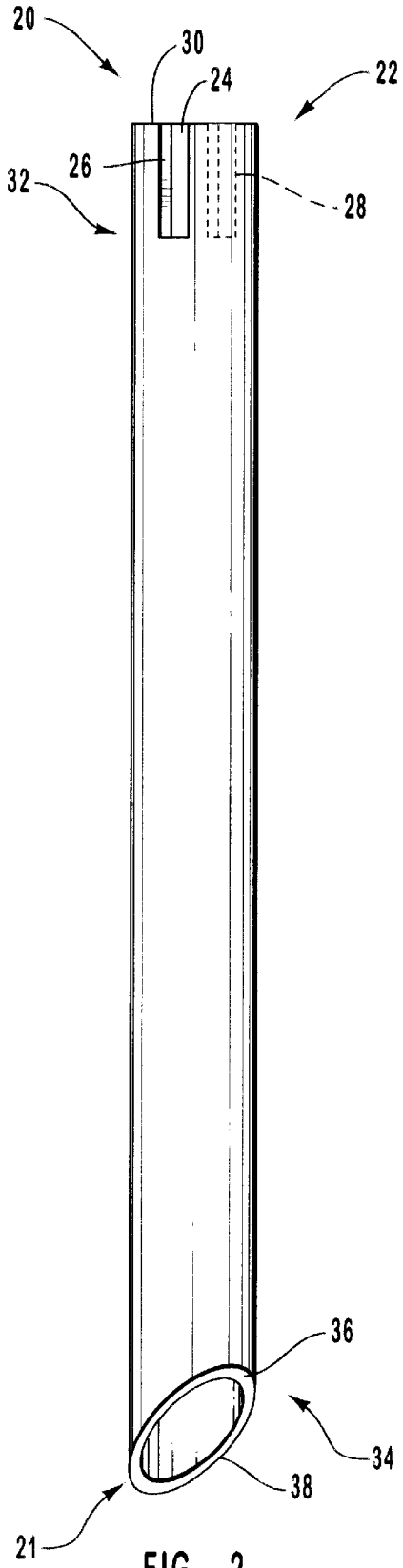
FIG. 2 is a perspective view of a stake for holding a light fixture of the present invention.
Figure 4:
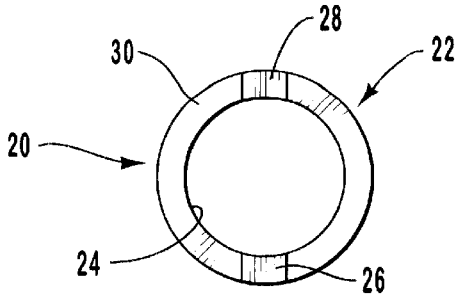
FIG. 4 is a top view of the stake of FIG. 2.
Figure 3:
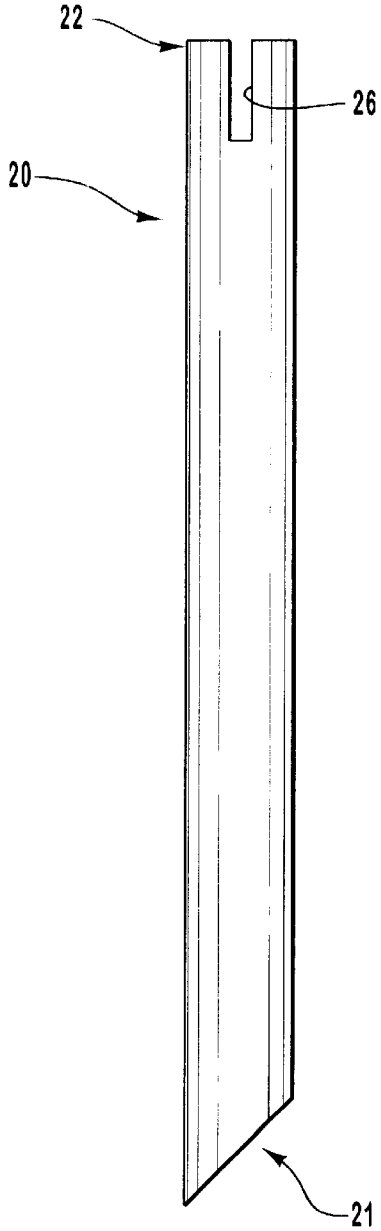
FIG. 3 is a side view of the stake of FIG. 2.

As shown in FIGS. 2–4, in one embodiment stake 20 preferably comprises a pipe which is sized large enough to allow insertion of the base of a light to be inserted at the top or receiving end 22 of the pipe, wherein receiving end 22 is slotted on either side to provide a place for the electrical wire of a continuous string of lights to enter one side and exit on the opposite side.

Stake 20 preferably comprises a length of hollow pipe having a cylindrical body 34. Body 34 has a longitudinally extending tubular wall extending between upper end 30 of receptacle 24 and a bottom rim 38 of insertion end 21. In another embodiment, however, insertion end 21 and the remainder of body 34 up to the bottom end 32 of receptacle 24 constitute a solid piece with receiving end 22 being hollow to receive a socket. Nevertheless, entire body 34 of stake 20 is preferably a hollow cylindrical body 34 such that stake 20 is lightweight and inexpensive to manufacture. For strength and convenience in manufacturing, body 34 is preferably a unitary body.

Bottom rim 38 of insertion end 21 is oriented at an angle with respect to the longitudinal axis of cylindrical body 34, forming a sharpened tip for enabling insertion end 21 to be conveniently inserted into the ground surface. Although the angle of rim 36 is preferably 4520 , any angle forming a sharp, slanted tip that is suitable for the purpose of allowing end 21 to be inserted into the ground may be employed.

With reference now to FIG. 4, body 34 of stake 20 has a generally uniform circular cross sectional configuration. Since stake 20 is an elongate cylindrical member having a generally continuous cross sectional configuration, stake 20 is stable. The preferred hollow nature of stake 20 also assists in making stake 20 light and inexpensive to produce. Also in light of the hollow configuration of stake 20, stake 20 can be made from fairly common products, including polyvinyl chloride ("PVC") plastic pipes, or other pipes found commonly in hardware stores and other retail and wholesale establishments. Such pipes can be readily cut into the desired lengths, after which one end of the pipe is slotted with opposing parallel slots 26, 28 and another end 21 is sharpened by being cut with a slant cut, as shown.

Figure 5:
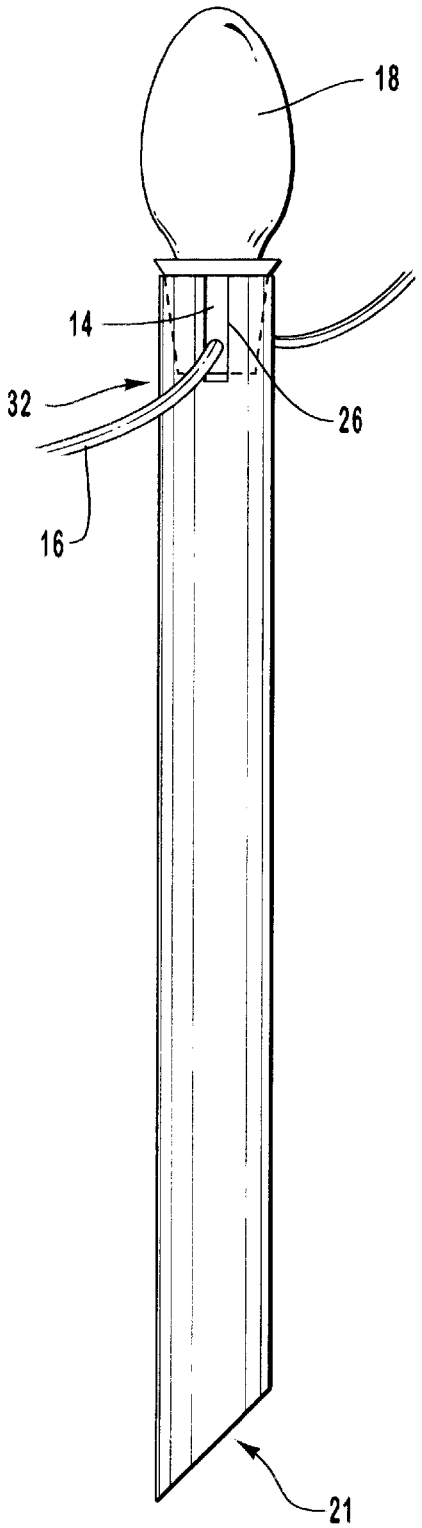
FIG. 5 is a side view of a stake of FIG. 2 holding a light fixture.

With reference now to FIGS. 5, a socket 14 is shown as being positioned in receiving end 22 of stake 20. Bulb 18 may be integrally received within socket 14. Optionally, however, bulb 18 is removable from socket 14 and is replaceable.

Figure 6:
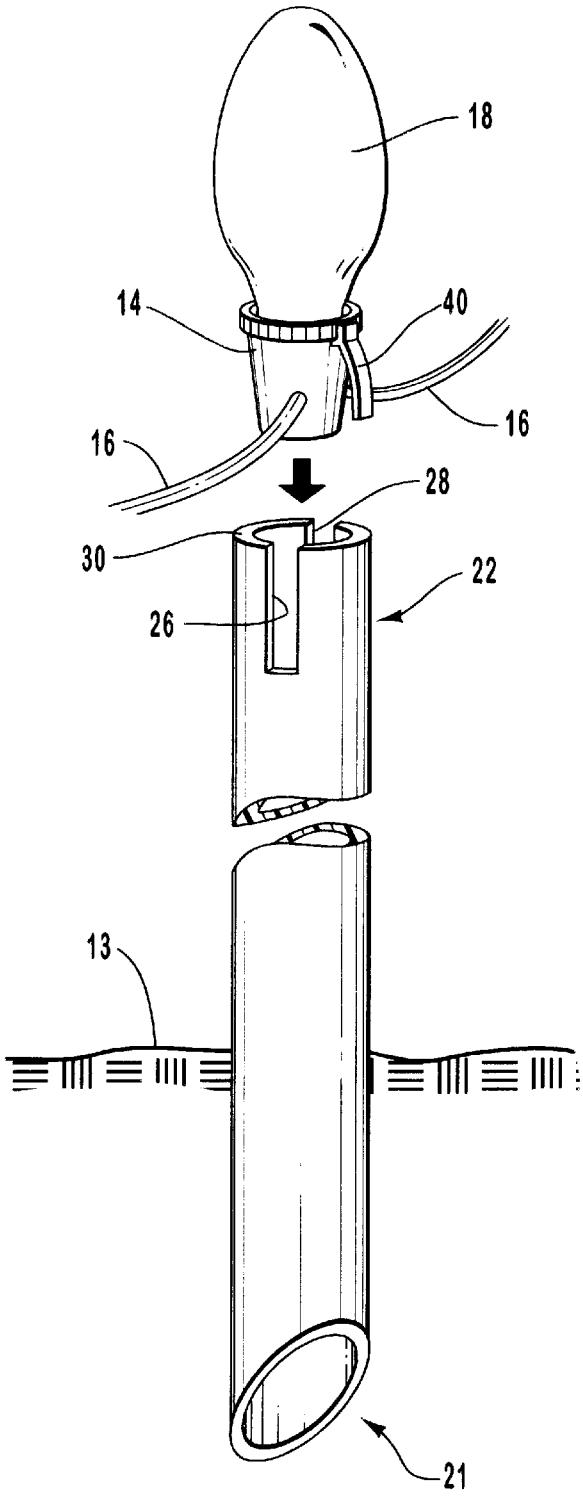
FIG. 6 is an exploded, cut away view of a decorative ground lighting system disposed within a ground surface.

As shown in FIG. 6, yet another advantage of the stakes 20 of the present invention is that the stakes 20 can accommodate sockets 14 having a clip 40 thereon as well as sockets lacking clips. In one embodiment, for example, a clip 40 coupled to socket 14 selectively extends over the top end 30 of receptacle 24. In another embodiment, receiving end 22 is large enough that clip 40 is positioned within the interior of receptacle 24.

Also as shown in FIG. 6, socket 14 is conveniently inserted into receiving end 22 by aligning opposing ends of electrical cord 16 within longitudinally oriented slots 26, 28 and by moving socket 14 downward within receiving end 22. Socket 14 is also readily retracted from longitudinal slots 26, 28 by merely pulling socket 14 upward. Thus, longitudinal slots 26, 28 assist in making the insertion and retraction of socket 14 convenient and efficient.

Stake 20 is readily placed into the ground either before or after socket 14 has been placed therein. The ground may be any support surface capable of receiving stake 20 and maintaining stake 20 in an upright position, such as dirt, grass, gravel, garden areas, or a permeable material, such as a foam or cushioned material capable of receiving stake 20 and maintaining stake 20 in an upright position.

FIGS. 2–5 show a basic view of stake 20. In one embodiment, stake 20 is made of a single piece of thick-wall schedule 40-PVC ¾ inch or 1½ inch pipe approximately 12 inches in length wherein the bottom end of the pipe is cut on a 45 degree angle to provide ease of insertion into the ground and the top end has a ¼ inch slot which extends through both walls of the pipe to allow a continuous string of large base outdoor Christmas lights to be inserted base down with the bulb pointed straight up.

In addition, as shown in FIGS. 1 and 5, the configuration of stake 20 simulates that of a candlestick such that stake 20 can be employed as an elegant decorative piece. For example, when stakes 20 are inserted into the ground in a continuous row, (approximately 11 inch centers) with white (or colored) decorative Christmas lights inserted, they form a very attractive and stimulating yard decoration.

Stakes 20 may be sold separately or as a packaged set comprising a number of different stakes. By way of illustration, a packaged set of stakes 20 may include 25, 30, 50, or 100 stakes 20 to accommodate strings of numerous outdoor Christmas lights, for example.

Figure 7:
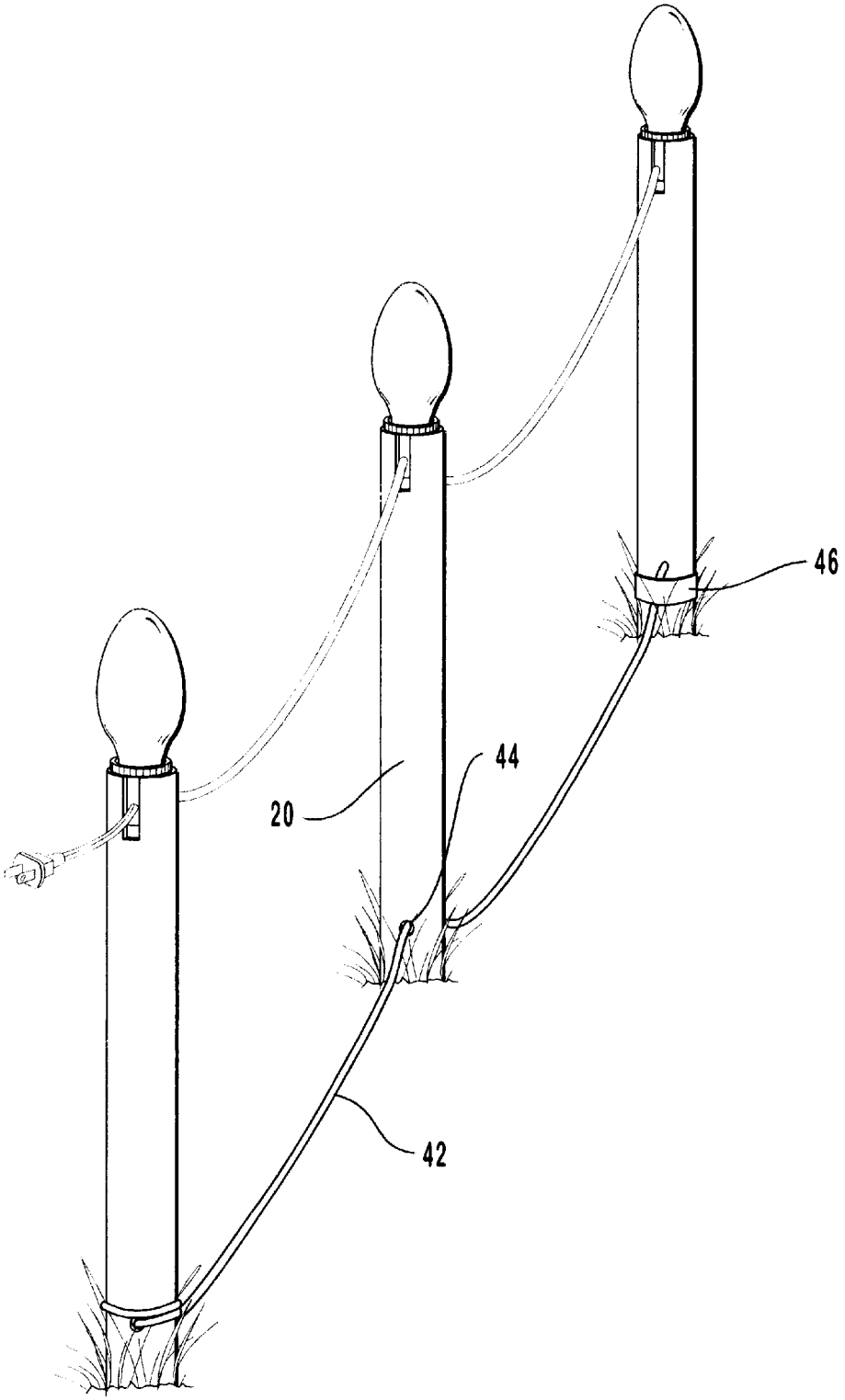
FIG. 7 is a perspective view of a series of stakes of the present invention shown as being coupled together in an organized fashion.

Stakes 20 may be hooked in series as is the case with regular Christmas lights, depending upon voltage limitations and used to line walk-ways, yard perimeters, driveways, etc. For example, as shown in FIG. 7, two or more stakes 34 may be hooked together through the use of a cord coupled to stakes 20. A variety of different stakes 20 may have a cord 42 coupled thereto, forming a string of stakes 20. Stakes 34 may be coupled by having a cord 42 extending through an aperture 44 in body 34 for example, or through the use of an adhesive or mechanical fitting, such as a clamp 46 coupled to a given stake 34 for example. Cord 42 is an example of cord means for joining each stake to at least one adjacent stake at a predetermined distance from one another. Cord 42 keeps stakes in a group, preventing loss and providing convenience storage.

Figure 8A:
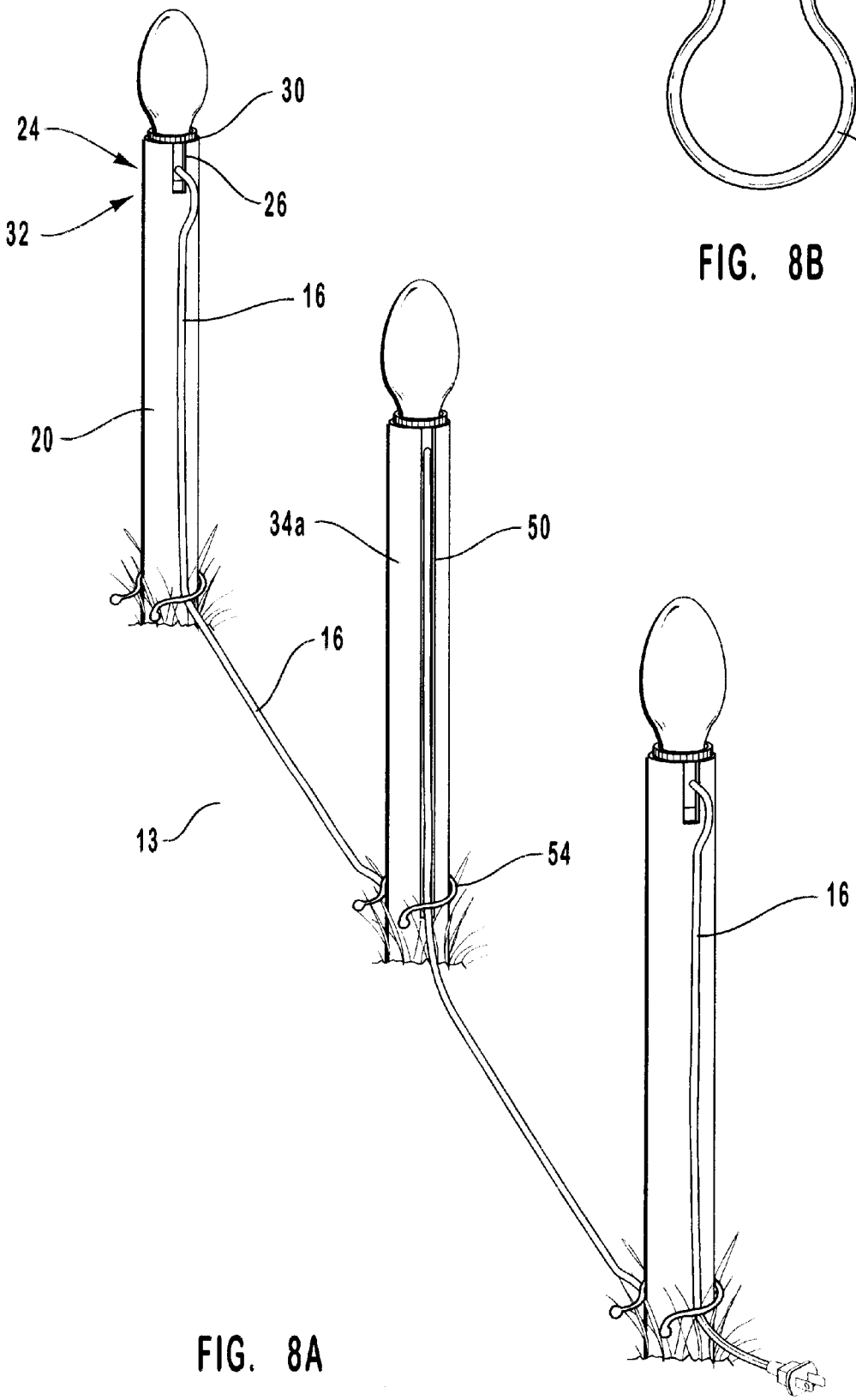
FIG. 8*a* is a perspective view of a decorative ground lighting system of the present invention featuring a clip of the present invention coupling wiring to stakes adjacent the ground surface in order to prevent individuals from tripping on the wiring.
Figure 8B:
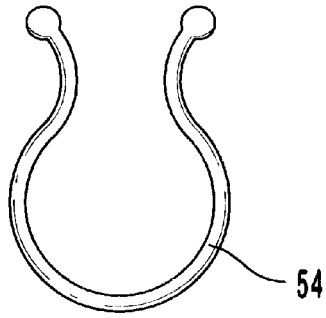
FIG. 8*b* is an example of a clip which can be employed for removably coupling wiring to stakes.

With reference now to FIGS. 8*a* and 8*b*, another example of a means for removably seating and securing wiring 16 comprises at least one and preferably first and second slots 50 running from a top end 30 of receptacle 24 to a point near ground surface 13 when stake 34*a* is driven into ground surface 13. Wiring 16 fits elegantly into slot 50 such that wiring 16 is not exposed along the body of stake 34*a*.

A clip means such as removable clip 54 or another clip may also be provided for removable attachment onto and around stake 34*a* to secure wiring 16 at a point near ground surface 13. Clip 54 maintains a portion of wiring 16 within slot 50 near ground surface 13 and ensures that the wiring disposed on the ground does not trip an individual or pet.

In another embodiment, also as shown in FIG. 8*a*, a slot 26 such as discussed with reference to FIG. 2 extends to a point near a bottom end 32 of receptacle 24. Wiring 16 extends from slot 26 and clip 54 maintains wiring 16 against the body of stake 20 near ground surface 13.

There are many potential applications for system 10, such as Christmas, Halloween, weddings, special occasion party lights, and other variations. Stakes 20 offer a new, inexpensive variation to holiday yard decor which is unique. Decorative lights may also have a variety of different functional uses.

While the above description contains several specificities, these should not be construed as limitations on the scope of the invention, but rather as an exemplification of one preferred embodiment thereof. Many other variations are possible. For example, other sizes to accommodate smaller or different sizes of decorative light strings or custom made lights.

The candlestick could also be fitted with a supportive base for other sized indoor or outdoor type lighting, with other outdoor or indoor applications. Another variation may be a two part unit which has a metal spiked base which is first inserted into the ground, which has a receiver socket into which the plastic pipe is inserted. It may also prove to be economically marketable to custom make units with integrated lights (built in) to hide the wires going from one candlestick to the next by slotting the units at the bottom rather than at the top end thus having the wires at ground level rather than on the upper end.

Accessory items may also include an implement which fits into the top of the candlestick to prevent damage when inserting into very hard or partially frozen ground. All of the above would be, of course, dictated by market feasibility and cost of production.

Figure 9:
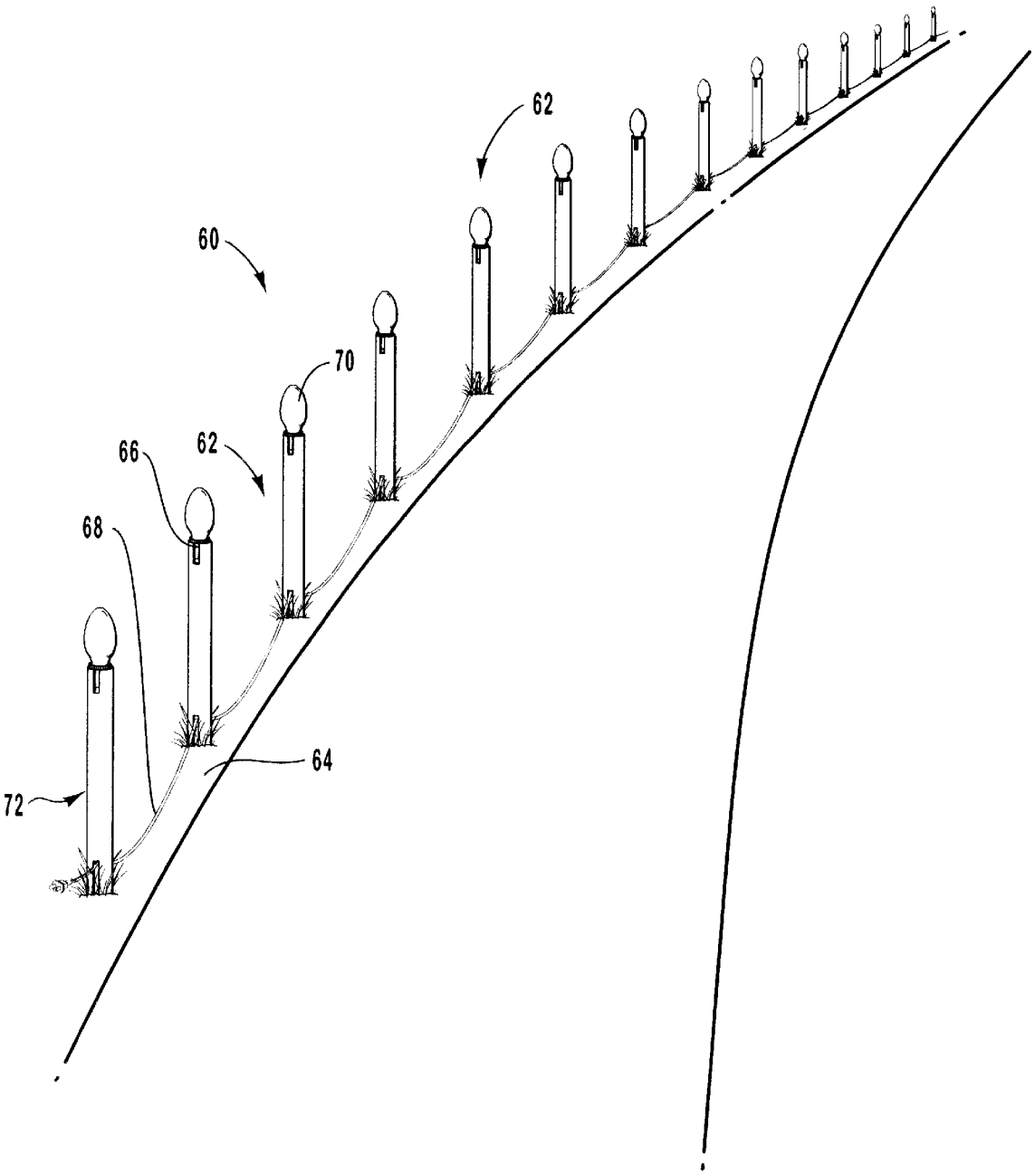
FIG. 9 is a perspective view of an alternative decorating ground lighting system of the present invention.

Another embodiment of a decorative lighting system 60 for deploying a string 62 of decorative lights above the ground surface 64 is shown in FIG. 9. System 60 comprises a string 62 of decorative lights comprising a plurality of electrical sockets 66. Each socket 66 is connected by wiring 68 strung between each of the sockets 66. Note that wiring 68 is placed adjacent the ground surface 64 in FIG. 9, preventing tripping over a wire extending above the ground. This dynamic is achieved through the use of slots in the sharpened insertion end of the stakes 72, as discussed below.

Each socket 66 receives a light bulb 70. System 60 further comprises a plurality of separate stakes 72, which are examples of separate stake means for holding the plurality of sockets 66. Each stake 72 holds an individual one of said sockets 66 and is separately deployable prior to stringing string 62 of decorative lights onto the stakes 72.

Figure 10C:
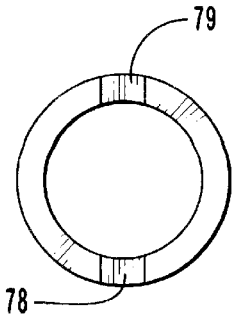
FIG. 10C is a top view of the stake of FIG. 10.
Figure 10:
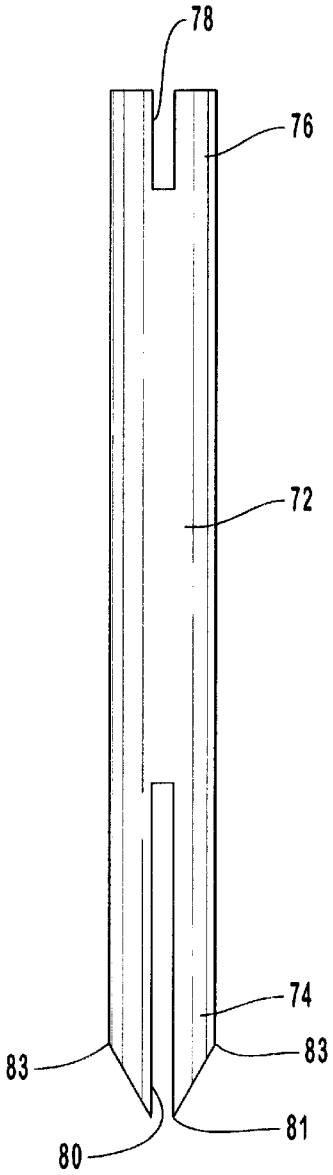
FIG. 10 is a perspective view of an alternative stake for holding a light fixture of the present invention.

With reference now to FIGS. 9 and 10, stake 72 is one example of structure which performs the function of a stake means for holding a decorative light. Stake 72 comprises: (i) a sharpened insertion end 74 to facilitate driving stake 72 through the ground surface 64 and into the ground to a desired depth and, (ii) a receiving end 76. Receiving end 76 of stake 72 is an example of receiving end means for removably receiving a socket of a decorative light therein. As discussed above with respect to FIG. 2, in one embodiment, receiving end 76 comprises a receptacle which is sized to receive at least one light socket in a friction fit manner.

In another embodiment, receiving end 76 receives the light socket in a non-friction fit manner while a clip connected to the socket clips onto the receiving end, such as by seating within one of slots 78, 79. In yet another embodiment, receiving end 76 receives the socket in both a friction fit manner and by having a clip connected thereto. Stake 72 is preferably a hollow pipe.

As mentioned, receiving end 76 has at least one, and optionally first and second slots 78, 79 (FIGS. 10, 10C) therein, each of which are examples of; (i) means for removably seating and securing wiring of a light fixture; and/or (ii) means for removably seating and securing a clip coupled to a socket. Stake 72 has a sharpened insertion end 74 which also has at least one aid preferably first and second slots 80 on opposing sides thereof. As shown, slots 80 extend from the lower tip 81 of the sharpened end 74 upwardly along at least a portion of sharpened end 74. Also as shown, in the embodiment of FIG. 10, slots 80 extend above shoulders 83 of sharpened end 74 such that shoulders 83 can be driven into the ground while the wiring extends out of slots 80 and can remain above the ground. Slots 80 are additional examples of means for removably seating and securing wiring of a light fixture.

Figure 10A:
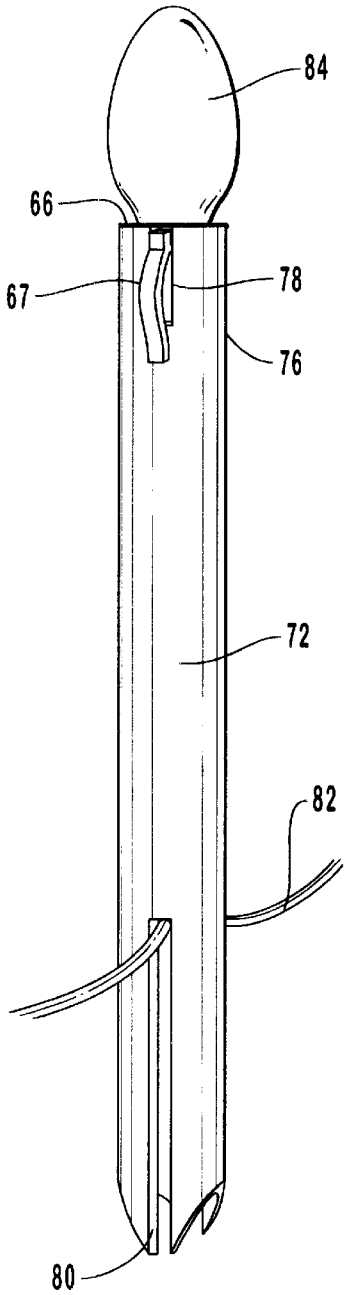
FIG. 10A is a view of the stake of FIG. 10 with a light fixture therein, wherein electrical wires of the light fixture extend out of slots in the sharpened insertion end of the stake.

As shown in FIG. 10A, in one embodiment, electrical socket 66 is mounted within receiving end 76 while wiring 82 thereof is mounted within slots 80. The light of FIG. 10A comprises socket 66, wiring 82 coupled to socket and lightbulb 84. According to one method of mounting socket 66 within receiving end 76, socket 66 is inserted through the hollow stake 72, beginning at the hollow sharpened insertion end 74, and continuing to insert socket 66 through stake 72 until socket 66 reaches receiving end 76, as shown in FIG. 10A. Wiring 82 is then extended through slots 80. In one embodiment, once socket 66 is inserted from end 80 through stake 72 into receiving end 76, light bulb 84 is mounted in socket 66, leaving wiring 82 extending through slots 80. In another embodiment (such as when bulb 84 is not removable from the socket 66), bulb 84 remains in socket 66 while socket 66 is inserted through stake 72 into sharpened insertion end 74.

Once socket 66 is mounted in receiving end 76, stake 72 can then be driven into the ground surface by placing the sharpened insertion end 74 adjacent the ground surface and forcing the sharpened insertion end 74 into the ground surface, such that wiring extending from stake 72 is placed adjacent the ground surface.

As shown in FIGS. 9 and 10A, by employing slots 80 in sharpened insertion end 74, wiring of the decorative light can be placed adjacent the ground surface 64, preventing tripping over a wire extending above the ground 64. As shown in FIG. 9, in one embodiment, stakes 72 are driven sufficiently into ground surface 64 to maintain stakes 72 in an upright position, but allow a portion of slots 80 to remain above the surface such that wiring extends conveniently from stakes 72.

In the embodiment of FIG. 10A, clip 67 coupled to socket 66 is seated within slot 78, such that clip 67 maintains socket 66 in a desired position within receiving end 76. Wiring 82, then extends downwardly within the hollow stake 72 and extends out of opposing slots 80. It will be appreciated from FIG. 10A that it is possible to seat clip 67 within a single slot 78, such that only one such slot is necessary. However, a plurality of upper and/or lower slots may be employed.

Figure 10B:
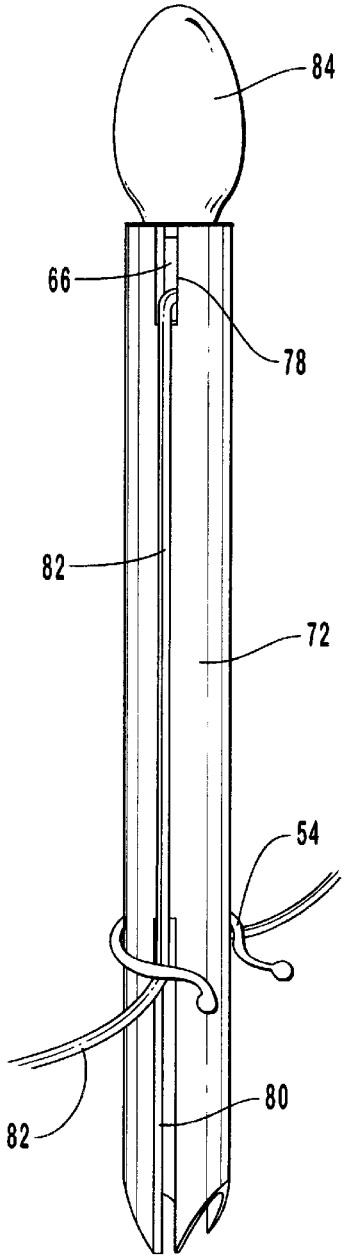
FIG. 10B is a example of a stake of the present invention holding a light fixture therein, wherein electrical wires of the light fixture extend down the side of the stake, have a portion thereof extending inside slots in the sharpened insertion end of the stake, and are coupled against the stake through the use of a clip.

In yet another embodiment, as shown in FIG. 10*b*, wiring 82 extends out of slots 78, 79 along the outside of stake 72 and into slots 80, such that clip 54 of FIG. 8*b* or another clip can conveniently maintain wiring 82 against stake 72 without pinching wiring 82 against the body of stake 72, but instead, maintaining wiring 82 within slot 80 at the connection point between stake 72 and clip 54.

In yet another embodiment of a stake of the preset invention (not shown), the stake features slots at the sharpened insertion end, but has no slots at the upper receiving end. However, the use of at least one slot at each end provides the advantage of optional use of either upper or lower slots.

Stake 72 can be manufactured according to a variety of different methods. According to one method, a hollow elongate member is provided with at least one slot 80 (and preferably first and second slots) formed in sharpened insertion end 74 of the elongate member. Lower end 74 can be sharpened before slots 80 are formed. Preferably, at least one, and possibly first and second slots are also formed in an upper receiving end 76 of the hollow elongate member to form stake 72.

Figure 11:
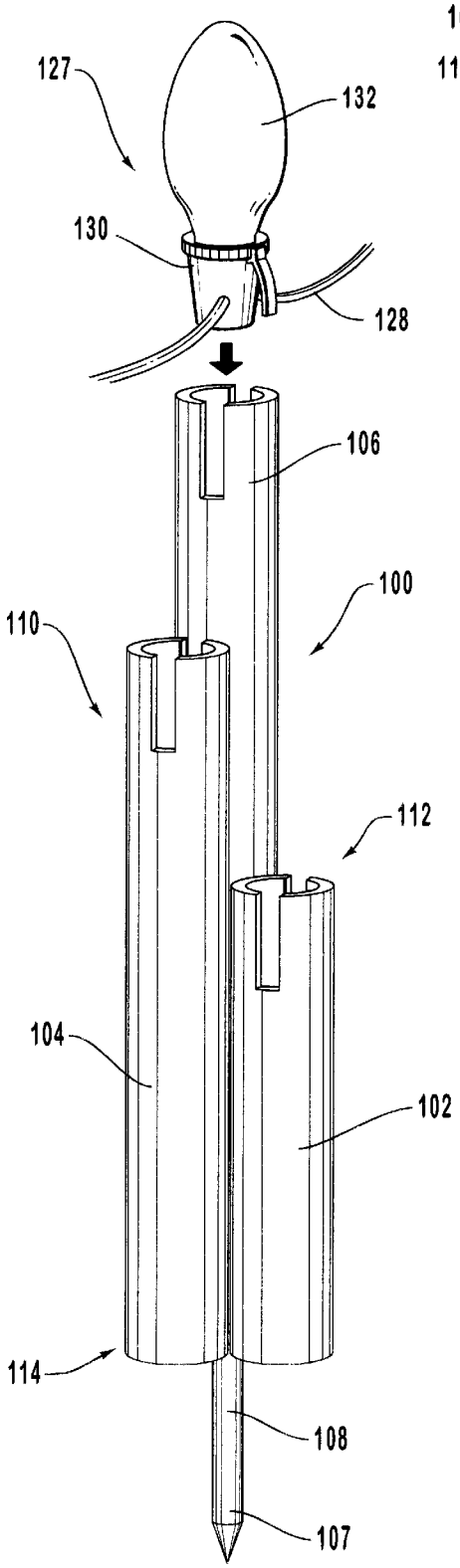
FIG. 11 is an example of a decorative lighting stake assembly of the present invention.

Another feature of the present invention relates to a decorative lighting stake assembly 100, an example of which is shown in FIG. 11. Assembly 100 is an example of a decorative lighting stake assembly for maintaining at least one decorative light above a ground surface.

Lighting assembly 100 comprises (i) a light fixture holder 110; and (ii) a stake 108 coupled thereto. Stake 108 is preferably selectively, removably coupled to holder 110. Holder 110 and stake 108 are selectively coupled in a mating relationship, e.g., by mounting holder 110 onto stake 108. In the embodiment of FIG. 11, holder 110 comprises a plurality of light fixture receiving members 102, 104, and 106 coupled together in an organized fashion. Receiving members 102, 104, and 106 form a clustered, triumvirate assembly which serves as a holder.

In the embodiment of FIG. 11, each receiving member 102, 104, and 106 comprises a length of hollow pipe having a cylindrically-shaped body. Each receiving member has an upper, receiving end, such that the overall light fixture holder 110 has a receiving end portion 112. The receiving end of each receiving member 102, 104, and 106 can be similar or identical to the receiving ends described above with reference to stake 20 or stake 72, for example. For example, the receiving ends of members 102, 104, 106 may each have at least one and possibly first and second slots therein.

Figure 12:
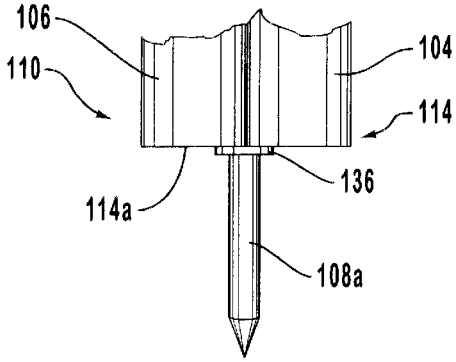
FIG. 12 is a view of yet another alternative embodiment of a decorative lighting stake assembly of the present invention, the assembly comprising the holder of FIG. 11 and a stake having a skirt member to retain the holder above the ground.

Each receiving member 102, 104, and 106 also has a lower end such that overall holder 110 has a lower end identified at 114. Lower end 114 may have a variety of configurations such as the flat configuration as shown in FIGS. 11 and 12. Optionally, at least one of the receiving members 102, 104, 106 has a sharpened insertion end configuration as shown in FIGS. 2–6 and FIGS. 10–10*b*, or a variety of other configurations. The flat shape of the lower end 114 of holder 110 of FIG. 11 is advantageous in part because holder 110 can remain resting flat on a surface, such as within or outside a home.

Figure 11A:
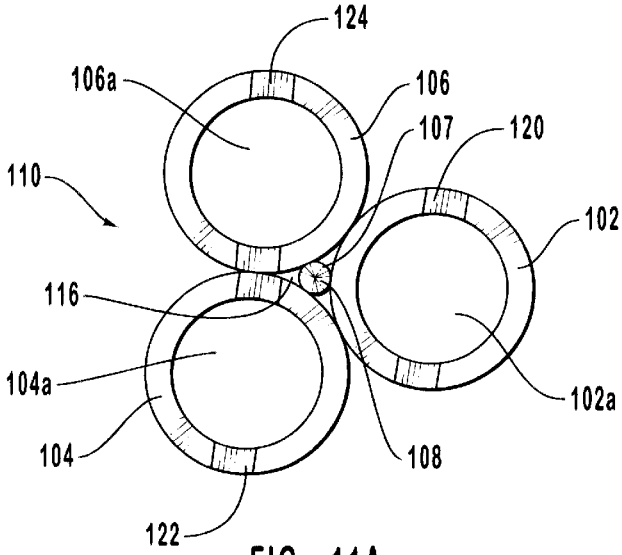
FIG. 11A is a top view of the assembly of FIG. 11.

FIG. 11A demonstrates an advantage to coupling the cylindrically-shaped receiving members 102, 104, and 106 to each other in a triangular cross sectional configuration. As shown, the triangular cross sectional configuration of FIG. 11A defines a hollow, triangular shaped shaft 116 defined by the adjacent surfaces of the first, second, and third receiving members 102, 104, and 106. Shaft 116 selectively mates with stake 118. Thus, holder 110 has a hollow shaft 116, and stake 118 selectively fits into shaft 116.

One advantage of removable stake 108 is that stake 108 can be selectively driven into the ground separately from holder 110. Next, holder 110 can be mounted on stake 108 by placing shaft 116 over stake 108. By employing removable stake 108, a hammer or other device can be employed to insert stake 108, after which the holder 110 is selectively mounted thereon. By so mounting holder 110, holder 110 is not damaged by contact from the hammer or other device. Instead, the hammer or other device contacts stake 108, after which holder 110 is mounted on stake 108.

Thus, stake 108 is separately deployable from holder 110 prior to coupling holder 110 to stake 108. In use, stake 108 is selectively driven partially into the ground surface, after which holder 110 is selectively coupled to stake 108. A first, lower end 107 of stake 108 is configured to be inserted into the ground surface to a desired depth and the second, upper end 109 is configured to be selectively coupled to holder 110, as shown in FIGS. 11 and 11A. A variety of different configurations of stakes can be employed to accomplish this selective coupling, including, for example, stakes which mate tightly within hollow shaft 116, stakes which fit into hollow shaft without a tight fit, but nevertheless retain holder 110 in an upright position, stakes having circular, square, rectangular, or triangular cross sections, for example, and a variety of other stakes which maintain holder 110 in an upright position. Optionally, a stake has a receiver socket into which a holder such as a holder 110 or another holder (e.g., holding a single light) is inserted.

Figure 11B:
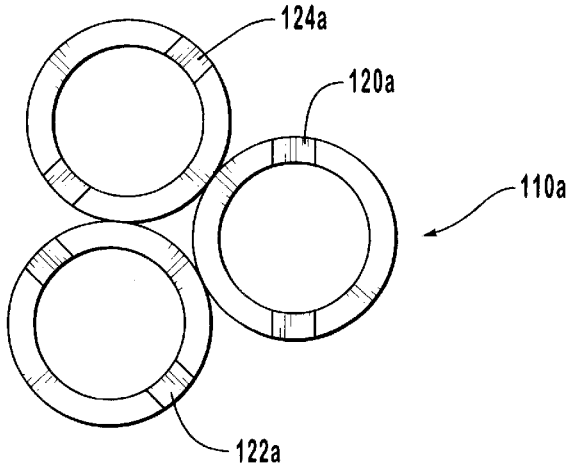
FIG. 11B is an alternative embodiment of a holder of the present invention.

In one embodiment, the slots 120, 122, and 124 of respective receiving members are arranged as shown in FIG. 11*a*. In other embodiments, slots 120*a*, 124*a*, and 122*a* of holder 110*a* are arranged as shown in FIG. 11B. Slots 120, 122, and 124 and 120*a*–124*a* selectively, removably receive wires 128 extending from sockets 130 or clips coupled to the sockets. Light bulbs 132 are coupled, optionally removably coupled, to such sockets 130. In yet another embodiment, one or more of the receiving members features only one slot. Such dual or single slots can be employed to seat one or two wires extending from a socket therein or to seat a clip of a socket therein.

Thus, one major advantage of assembly 100 is the ability to initially place a stake in the ground, then place stake 108 in the ground then place holder 110 thereon without risk of damaging either the holding assembly or the light fixtures 127, which is selectively removably placed into the various receiving ends of the respective receiving members 102, 104, and 106.

As shown in the embodiment of FIG. 11A, in one embodiment, the means for removably seating and securing wiring coupled to the light socket comprises a hollow shaft 102*a*, 104*a*, 106*a* extending through respective receiving members 102, 104, 106. Wiring can thus extend through shafts 102*a*, 104*a*, and/or 106*a* or may be placed in slots 120, 122, and/or 124, each of which are also examples of means for removably seating and securing wiring coupled to the light socket. Slots 120, 122, and/or 124 are also examples of means for removably seating and securing a clip coupled to a socket.

In one embodiment, wiring extends through at least one of shafts 102*a*, 104*a*, 106*a* and through at least one of slots 120, 122, 124. In this embodiment, the clips of the respective lights can be seated within the upper slots 120, 122, and/or 124, for example. Stake 108 is an example of stake means for selectively coupling holder 110 to the ground surface.

As shown, system 100 is also an example of a decorative lighting assembly for maintaining a plurality of decorative lights above a ground surface. Thus, holder 110 is an example of holding means for holding a plurality of decorative lights. Although it is possible to hold three lights with system 100, in another embodiment one, two, four, five, six, or more lights are held by a system having a stake removably coupled to a holder.

The body of receiving members 102, 104, 106 has generally uniform circular cross sectional configuration in a preferred embodiment thereof. Members 102, 104, 106 are stable, light and inexpensive to produce. As shown, members 102, 104, 106 can have at least two different lengths and preferably three different lengths or possibly four, five or more different lengths, in order to provide lighting at varying heights and for an appealing appearance.

Holder 110 is an example of holding means for holding at least one decorative light. In one embodiment, holder 110 is formed through the use of adhesive to couple receiving members 102, 104, and 106 together. Optionally, the receiving members can be integrally coupled, such as by forming holder 110 as a single integral unit. In another embodiment, holder 110 can be formed by binding individual receiving member together in a variety of other manners, such as through the use of a binding collar or strap extending about the receiving members.

Assembly 100 is a two-part unit having a variety of different advantages. For example, one advantage of assembly 100 of FIG. 11 is that it provides an aesthetically pleasing appearance and enables multiple lights to be held in a tight, vertically and horizontally offset configuration. Optionally, however, the lights at the receiving end of the holders may be more horizontally spaced from each other, such as by configuring the receiving ends to be more separated from each other.

Figure 12A:
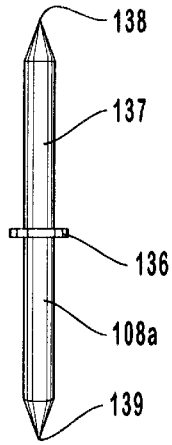
FIG. 12A is a view of the stake shown in FIG. 12.

In FIGS. 12 and 12A, an alternative stake 108*a* of the present invention is shown. Stake 108*a* comprises an elongate member 137 having a first, upper end 138, a second, lower end 139, and a skirt 136 located therebetween. Skirt 136 extends about at least a portion of elongate member 137, and preferably extends about the entire elongate member 137. Holder 110 is selectively mounted on skirt 136. Skirt 136 has a larger diameter than shaft 116, such that holder 110 rests on skirt 136.

FIGS. 11 and 12 also demonstrate that lower end 114 of holder 110 is flat, such that lower end 114 can be mounted on a support surface without the use of a stake, for example. Achieving a flat lower end 114 can be accomplished by employing flat lower ends on each of receiving members 102, 104, 106 and by positioning these flat lower ends adjacent to each other, as shown in FIGS. 11 and 12 in order to achieve an overall flat lower end 114. In a preferred embodiment, lower surface 114*a* of lower end 114 is transverse to the longitudinal axis of holder 110 such that lower surface 114*a* is readily mounted on a horizontal support surface while holder 110 is maintained in an upright, vertical position.

Stakes 108 and 108*a* are examples of spiked bases which are first inserted into the ground, after which a holder is mounted thereon. The stake and holder act as a convenient two-part unit. As another example of such a two-part lighting stake assembly comprising a stake selectively coupled to a holder, a stake has a receiver socket into which a holder such as a holder 110 or another holder (e.g., a single receiving member) is inserted.

Figure 13:
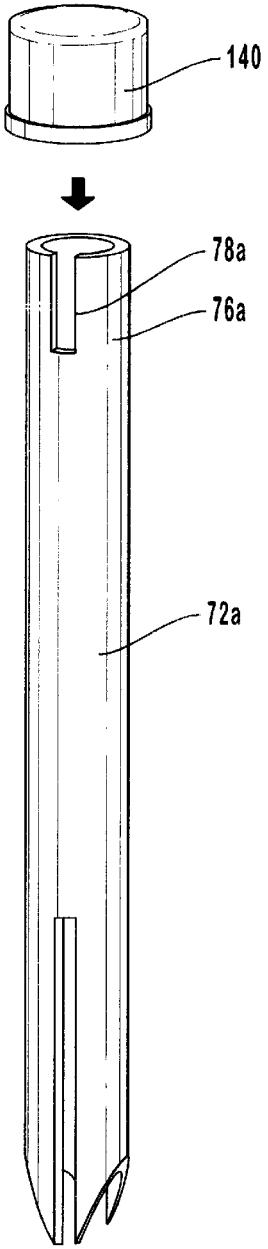
FIGS. 13 and 13A demonstrate the use of a cover to protect the top portion of a stake as the stake is driven into the ground.
Figure 13A:
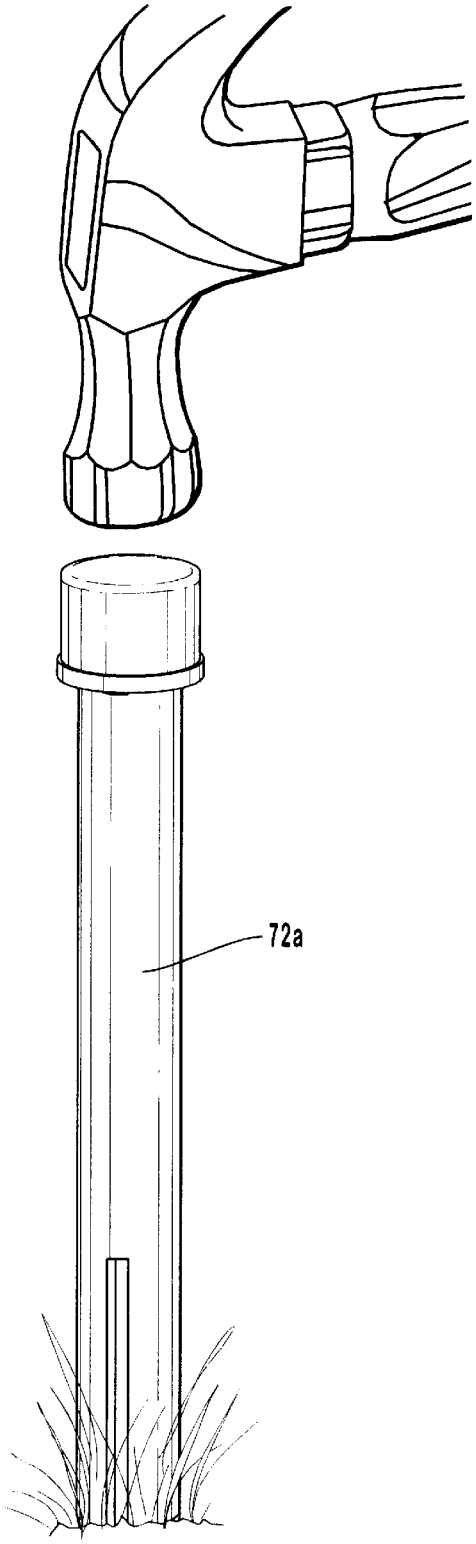

FIGS. 13 and 13*a* demonstrate an example of means for covering a receiving end 76*a* of stake 72*a*, namely, a cover 140 having a hollow cavity therein. Cover 140 can be mounted on receiving end 76*a*, as shown in FIG. 13*a*. Next, a hammer or another tool is used to force stake 72*a* into the ground by contacting cover 140 rather than stake 72*a*. Thus, stake 72*a* is not damaged during insertion. Cover 140 can be provided in a variety of different embodiments and having different shapes. Cover 140 is configured to be mounted on top of receiving end 76*a* and is removably coupled thereto. Cover 140 is an example of an implement to prevent damage to a stake when inserting it into very hard or partially frozen ground. Cover 140 is configured to cover at least a portion of the receiving end 76*a* of stake 72*a* as stake 72*a* is driven into the ground.

As shown in FIG. 13 stake 72*a* has a single upper slot 78*a* for receiving wiring and/or a clip coupled to a socket, although cover 140 may be employed on a variety of different stakes disclosed herein such as stake 72, for example. Receiving end 76*a* of stake 72*a* is thus another example of receiving end means for removably receiving a socket of a decorative light therein.

According to one technique, stakes 20, 72, 72*a*, and assembly 100 of the present invention maintain lights with wires above a desired surface. According to another technique, however, stakes 20, 72, 72*a*, and assembly 100 maintain battery powered lights above a surface. Thus, power can be either AC or DC. For example, in one embodiment, a light socket having a battery therein is received within the receiving end 76 of stake 72. The socket received within the receiving end of a stake or receiving member of the present invention can thus be a socket coupled to a wire or a socket having a battery therein.

Thus, a battery powered light can be mounted within one or more of receiving members 102, 104, 106 of light fixture holder 110. Light fixture holder 110 can be mounted onto a support surface and stand upright without the use of stake 108 and receive such battery powered lights. Placing battery operated lights within light fixture holder 110 can be useful for home or outdoor use. This can be accomplished, for example, by mounting flat lower end 114 onto a support surface and mounting one or more battery operated lights within one or more receiving members 102, 104, 106.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A decorative lighting assembly for maintaining at least one decorative light above a ground surface, the decorative lighting assembly receiving at least one decorative light, the decorative lighting assembly comprising:

holding means for holding at least one decorative light, the holding means selectively, removably receiving at least one decorative light, such that the at least one decorative light is selectively deployed by inserting a portion of the at least one decorative light into the holding means; and stake means for selectively coupling the holding means to the ground surface, the stake means being separately deployable from the holding means prior to selectively coupling the holding means to the stake means, such that the stake means is selectively driven partially into the ground surface, after which the holding means is selectively coupled to the stake means, the stake means having a first end and a second end, the first end being configured to be inserted into the ground surface to a desired depth and the second end configured to be coupled to the holding means wherein the holding means further comprises means for removably seating and securing wiring of the decorative light; and wherein the means for removably seating and securing wiring comprises at least one slot within the holding means, the slot being longitudinally oriented with respect to the holding means; wherein said holding, means comprises first, second and third lengths of hollow pipe coupled to each other and wherein said first, second, and third lengths of pipe are arranged in a triangular cross-sectional configuration and are each offset both horizontally and vertically.

2. A decorative lighting assembly as defined in claim 1, wherein the holding means and the stake means are selectively coupled in a mating relationship, the holding means being selectively mounted onto the stake means.

3. A decorative lighting assembly as recited in claim 2, wherein the holding means has a hollow shaft, and wherein the stake means selectively fits into the shaft.

4. A decorative lighting assembly as recited in claim 1, wherein the triangular cross sectional configuration defines a hollow shaft defined by adjacent surfaces of the first, second, and third pipes.

5. A decorative lighting assembly as recited in claim 4, wherein the pipes are each cylindrically shaped.

6. A decorative lighting assembly as defined in claim 1, wherein the decorative light comprises an electrical socket, and wherein the slot selectively seats the clip.

7. A decorative lighting assembly as defined in claim 6, wherein the means for removably seating and securing wiring comprises first and second opposing slots within the holding means.

8. A decorative lighting assembly as defined in claim 6, wherein the means for removably seating and securing wiring comprises at least one hollow shaft extending through the holding means.

9. A decorative lighting assembly for maintaining at least one decorative light above a ground surface, the decorative lighting stake assembly receiving the decorative light, the decorative lighting stake assembly comprising:

a holder configured to selectively hold at least one decorative light therein, the holder comprising a receiving end which selectively, removably receives a portion of at least one individual light therein, so that the at least one light is selectively deployed by inserting the portion of the at least one light into the receiving end; and a stake selectively, removably coupled to the holder, the stake selectively coupling the holder to the ground surface, the stake being separately deployable from the holder prior to coupling the holder to the stake, such that the stake is selectively driven partially into the ground surface, after which the holder is selectively coupled to the stake, the stake having a first end and a second end, the first end being configured to be inserted into the ground surface to a desired depth and the second end configured to be coupled to the holder;

wherein the holder comprises a plurality of lengths of hollow pipe configured such that a stake is selectively mounted within a shaft defined by the adjacent surfaces of the respective lengths of hollow pipe.

10. A decorative lighting assembly as defined in claim 9, wherein the holder has a hollow shaft, and wherein the stake selectively fits into the hollow shaft, such that the stake is selectively coupled in a mating relationship with the holder, the holder being selectively mounted onto the stake.

11. A decorative lighting assembly as recited in claim 9, wherein the stake comprises an elongate member having a first end, a second end, and a skirt located in between the first end and the second end, the skirt extending about at least a portion of the elongate member, the holder being selectively mounted on the skirt.

12. A decorative lighting assembly as defined in claim 9, wherein said holder comprises a plurality of lengths of hollow pipe coupled to each other, the hollow shaft extending between the coupled lengths of pipe.

13. A decorative lighting assembly as recited in claim 12, wherein the lengths of hollow pipe comprise first, second, and third lengths of vertically offset pipe arranged in a triangular cross-sectional configuration such that the triangular cross sectional configuration defines the shaft, the shaft being a hollow, triangular shaped shaft defined by adjacent surfaces of the first, second, and third cylindrically shaped pipes.

14. A decorative lighting stake assembly for maintaining a plurality of decorative lights above a ground surface, the decorative lights each having an electrical socket, the electrical socket receiving a light bulb and having wiring coupled thereto, the decorative lighting stake assembly receiving the electrical sockets, the decorative lighting stake assembly comprising:

holding means for holding a plurality of decorative lights, the holding means comprising receiving end means for selectively, removably receiving a plurality of individual light sockets therein, so that a plurality of lights are selectively deployed by inserting tile sockets of the lights into the receiving end means, the holding means comprising means for removably seating and securing wiring of the decorative light; and stake means selectively, removably coupled to the holding means for selectivity coupling the holding means to the ground surface, the stake means being separately deployable from the holding means prior to coupling the holding means to the stake means, such that the stake means is selectively driven partially into the ground surface, after which the holding means is selectively coupled to the stake means, the stake means having a first end and a second end, the first end being configured to be inserted into the ground surface to a desired depth and the second end configured to be coupled to the holding means, wherein the holding means comprises a plurality of receiving members, the receiving members configured to define a shaft therebetween, and wherein the stake is selectively mounted within the shaft.

15. A decorative lighting stake assembly for maintaining a plurality of decorative lights above a ground surface, the decorative lights each having an electrical socket, the electrical socket receiving a light bulb and having wiring coupled thereto, the decorative lighting stake assembly receiving the electrical sockets, the decorative lighting stake assembly comprising:

holding means for holding a plurality of decorative lights, the holding means comprising receiving end means for selectively, removably receiving a plurality of individual light sockets therein, so that a plurality of lights arc selectively deployed by inserting the sockets of the lights into the receiving end means, the holding means comprising means for removably scating and securing wiring of the decorative light; and stake means selectively, removably coupled to the holding means for selectively coupling the holding means to the ground surface, the stake means being separately deployable from the holding means prior to coupling the holding means to the stake means, such that the stake means is selectively driven partially into the ground surface, after which the holding means is selectively coupled to the stake means, the stake means having a first end and a second end, the first end being configured to be inserted into the ground surface to a desired depth and the second end configured to be coupled to the holding means, wherein a clip is coupled to the electrical socket of the light and wherein the holding means comprises a slot for selectively seating the clip.

16. A light stake for use in a decorative lighting system for deploying a string of decorative lights above a ground surface, each decorative light comprising a light socket and wiring coupled to the light socket, the stake selectively holding an individual one of said sockets, the light stake comprising:

receiving end means for removably receiving a socket of a decorative light, the receiving end means having a receptacle formed therein which is sized to removably receive a socket of a decorative light, and a sharpened end to facilitate driving the stake through the ground surface and into the ground to a desired depth, the sharpened end having at least one slot therein into which the wiring of said decorative light is removably extended, such that the wiring is selectively placed adjacent the ground surface when the stake is mounted in the ground surface, the at least one slot extending from the lower tip of the sharpened end upwardly along at least a portion of the sharpened end.

17. A stake as recited in claim 16, wherein the sharpened end comprises first and second slots and wherein the slots extend above shoulders of the sharpened end, such that the shoulders can be driven into the ground while the wiring of the light extends out of the slots.

18. A stake as recited in claim 16, further comprising a cover configured to cover the stake as the stake is driven into the ground.

19. A decorative lighting system for deploying a string of decorative lights above a ground surface, the decorative lighting system comprising:

a string of decorative lights comprising a plurality of electrical sockets each connected by wiring strung between each of the sockets, each socket receiving a light bulb; and a plurality of separately deployable stakes, each said stake selectively holding an individual one of said sockets, and comprising:

a sharpened end to facilitate driving the stake through the ground surface and into the ground to a desired depth, the sharpened end having at least one slot therein into which the wiring of said light string is removably secured, such that the wiring is selectively placed adjacent the ground surface, the slot extending from the lower tip of the sharpened end upwardly along at least a portion of the sharpened end; and a receiving end having a receptacle formed therein which is sized to removably receive one of said sockets of the light string.

20. A lighting system as recited in claim 19, wherein said receiving end includes at least one slot therein into a clip of a light socket is removably seated.

21. A lighting system as recited in claim 19, further comprising a cover configured to cover at least a portion of the receiving end of a stake as a stake is driven into the ground.

22. A method for mounting a socket of a decorative light within a stake configured to maintain the decorative light above a ground surface, comprising:

providing a hollow stake having (A) a sharpened end to facilitate driving the stake through a ground surface and into the ground to a desired depth, the sharpened end having at least one slot therein into which wiring coupled to the socket is removably secured, such that the wiring is selectively placed adjacent the ground surface when the stake is driven into the ground surface, the slot extending from a lower tip of the sharpened end upwardly along at least a portion of the sharpened end; and (B) a receiving end having a receptacle formed therein which is sized to removably receive a socket of a light, inserting a socket of a decorative light through the hollow stake, beginning at the sharpened insertion end, and continuing to insert the socket through the stake until the socket reaches the receiving end; and extending the wiring coupled to the socket through the at least one slot in the sharpened insertion end.

23. A method as recited in claim 22, further comprising mounting a light bulb within the socket.

24. A method as recited in claim 22, wherein the stake further has a slot in the receiving end thereof and further comprising seating a clip coupled to the socket into the slot in the receiving end.

25. A method as recited in claim 22, wherein the stake can be driven into the ground surface by placing the sharpened insertion end adjacent the ground surface and forcing the sharpened insertion end into the ground surface, such that wiring extending from the stake is placed adjacent the ground surface.

* * * * *